US008544115B1

(12) United States Patent
Gravenstein et al.

(10) Patent No.: US 8,544,115 B1
(45) Date of Patent: Oct. 1, 2013

(54) MATERIALS AND METHODS FOR MAINTAINING PROPER BODY TEMPERATURE

(75) Inventors: Nikolaus Gravenstein, Gainesville, FL (US); Dasia Esener, Gainesville, FL (US); Samsun Lampotang, Gainesville, FL (US); Michael D. Gilmore, Newberry, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 3341 days.

(21) Appl. No.: 10/652,133

(22) Filed: Aug. 29, 2003

Related U.S. Application Data

(60) Provisional application No. 60/442,474, filed on Jan. 23, 2003, provisional application No. 60/448,822, filed on Feb. 21, 2003.

(51) Int. Cl.
*A62B 17/00* (2006.01)

(52) U.S. Cl.
USPC ..... 2/81

(58) Field of Classification Search
USPC ..... 2/69, 81, 102, DIG. 1, 456, 69.5
See application file for complete search history.

(56) References Cited

U.S. PATENT DOCUMENTS

| | | | | |
|---|---|---|---|---|
| 2,052,869 | A | 9/1936 | Henri | |
| 4,026,299 | A | 5/1977 | Sauder | |
| 4,451,934 | A * | 6/1984 | Gioello | 2/113 |
| 4,457,295 | A * | 7/1984 | Roehr | 126/204 |
| 5,320,164 | A * | 6/1994 | Szczesuil et al. | 165/46 |
| 5,386,701 | A * | 2/1995 | Cao | 62/259.3 |
| 5,533,354 | A | 7/1996 | Pirkle | |
| 5,970,519 | A * | 10/1999 | Weber | 2/81 |
| 6,119,474 | A | 9/2000 | Augustine et al. | |
| 6,131,645 | A | 10/2000 | Barr | |
| 6,487,871 | B1 | 12/2002 | Augustine et al. | |
| 6,565,699 | B1 * | 5/2003 | Szczesuil et al. | 156/290 |
| 6,901,608 | B2 * | 6/2005 | Szczesuil et al. | 2/458 |

* cited by examiner

*Primary Examiner* — Tejash Patel
(74) *Attorney, Agent, or Firm* — Saliwanchik, Lloyd & Eisenschenk

(57) ABSTRACT

The subject invention provides materials and methods for convective and/or conductive and/or evaporative cooling of individuals, such as athletes and contestants, for safety, comfort, and enhanced performance. The materials and methods of the subject invention can, advantageously, be used to modify body core temperature or rate of change of temperature. Other uses include heating players or player parts (e.g., a kicker's leg, a pitcher's arm) in cold weather conditions.

42 Claims, 2 Drawing Sheets

MATERIALS AND METHODS FOR MAINTAINING PROPER BODY TEMPERATURE

CROSS-REFERENCE TO RELATED APPLICATIONS

This application claims the benefit of U.S. Provisional Application Ser. No. 60/442,474, filed Jan. 23, 2003 and U.S. Ser. No. 60/448,822, filed Feb. 21, 2003.

BACKGROUND OF INVENTION

The human body can tolerate relatively small changes in internal body core temperature; however, considerable fluctuations pose serious, potentially life-threatening, health risks. Significant changes in the core body temperature cause conditions ranging from mild weakness and fatigue to decreased performance, coma and death.

Although all walks of life are susceptible to the dangers and discomfort of fluctuations in internal body core temperature, as evidenced by the thousands of heat-related deaths in France in the summer of 2003, athletes are at particularly high risk as they are more often subjected to unusual temperature (especially heat) stress.

In recent years, there has been a high occurrence of death associated with heat-related illnesses (e.g., heat exhaustion, severe heat cramps and heat stroke). In the United States alone, over 300 deaths per year are attributable to heat-related illnesses. Athletes are particularly vulnerable to heat-related illnesses and discomfort. Every year millions of athletes and contestants participate in sports that require competing or practicing in hot, humid environments. Under such circumstances, the body is often overwhelmed with uncompensated heat stress, which can be fatal. Heat-related illness is second only to head injuries as a cause of death among athletes in the United States. Due to the heavy equipment and uniform required, football players have increased risks of suffering from heat stress problems.

Elevations in core temperature also promote sweating which aggravate exercise-induced hypovolemia and contribute to dehydration. A rise in core temperature is also associated with a decline in athletic performance. During 2001, a series of heat-related injuries and deaths in college and professional football players brought national attention to the critical dangers of exercising in excessive heat. The combination of extreme heat and strenuous exercise proved deadly for two top football players, Eraste Thomas Autin and Korey Stringer. During a workout in 102° heat, Eraste Thomas Autin, 18, incoming freshman and aspiring player for the University of Florida Gators, collapsed, fell into a coma and subsequently died. Within a month of Autin's death, Korey Stringer, 27, offensive lineman for the Minnesota Vikings, also fatally fell victim to a heat stroke during practice. Upon arrival at a Minnesota hospital, Stringer's body temperature was more than 108° causing his organs to fail and lead to his ultimate death. It is important to note that these individuals were involved in highly sophisticated athletic programs where tremendous effort is made to avoid such tragedies. Clearly, there is a critical need to identify and implement improved methods for avoiding overheating in athletes and contestants.

Traditionally, athletes have relied upon contact conductance (using cool, wet towels or ice packs) to promote cooling and reduce core body temperature. However, these methods may not be totally effective in preventing overheating, especially when attempting to cool down football players in full uniform. Fans and misters have also been found to be only partially effective. By these methods, the body's core temperature may not be reduced effectively enough, which can lead to damage to multiple organs, including the heart, kidney, brain and liver.

Excessively cold environmental conditions can also hinder peak [athletic] performance and may have severe health implications for athletes. Once body temperature falls below just ninety-four degrees Fahrenheit, the hypothalamus loses its ability to regulate body temperature properly and health problems begin to accelerate. Also, as body temperature decreases in cold weather, muscles insufficiently warmed-up are more prone to injury, blood clots more easily, which increases the risk of a coronary artery blockage and hypothermia may strike from the combination of frigid air and sweat. It is important that athletes and contestants protect themselves from these potential health safety hazards while competing in cold weather.

Conductive and/or convective heating may be used to achieve desired thermal heating of athletes, or specific body parts, e.g., kicker's leg or pitcher's arm, in cold weather conditions. Muscle injury may be minimized and athletic performance is improved by keeping vulnerable limbs warm in cold environments.

In a constant pursuit to protect the health and safety of athletes while participating in hot and/or cold weather sports activities, there are a number of inventions that have been designed to modulate an individual's internal core body temperature. Although these inventions appear to be somewhat useful and contribute to the art of the invention (e.g., U.S. Pat. Nos. 2,052,869; 4,026,299 and 6,119,474), they prove not to be ideal for use in certain activities and sports, such as football, for one reason or another (such as being cumbersome, heavyweight and/or unmanageable).

It is clear that in order to ensure safety and enhance performance, an athlete's physiologic adaptation to his/her environment would be greatly facilitated by use of an improved system for controlling core body temperature. The system does not necessarily need to utilize the Coanda effect and could be made as part of a garment and/or protective gear. The subject invention fulfills these and other needs.

BRIEF SUMMARY

The subject invention provides devices and methods that can be used to [easily and effectively] decrease or increase body temperature. In a preferred embodiment, core body temperature may be reduced and/or the rate of core temperature change be modified. The materials and methods of the subject invention can, advantageously, be used for cooling or heating of athletes, contestants and others for safety and enhanced performance.

In a preferred embodiment, the subject invention involves the routing of a fluid, preferably a gas, by way of conduits incorporated or attached into a garment, to create a cooling or heating effect for the wearer. The apparatus can have a fluid source that is either external or internal. In the case of an internal source, a self-contained unit with a reservoir for the fluid source can be provided.

In a preferred embodiment, fluid-conveying conduits are provided in protective gear. The conduits are capable of holding and/or directing or channeling a fluid. The conduits may be formed by a material that is different than the protective gear, or the conduits may be defined by the material of the protective gear itself.

In a particularly preferred embodiment, conduits are incorporated into an athlete's gear (such as pads or a helmet).

Specifically exemplified herein is a system for cooling a football player. A cooling effect is created as air passes through the conduits in close proximity to the surface of a person who needs to be cooled. Specifically exemplified herein is an apparatus with an air source that is external and which is equipped with a low-profile quick-connect fitting for efficient connection/disconnection of the apparatus to/from the air source.

In a specific embodiment, the subject invention provides methods for modulating the body temperature of a football player. These methods preferably involve the delivery of compressed air through the tubing vessels (conduits) located in a garment wherever a decrease in elevated body core temperature is desired. Advantageously, the movement of air through tubing vessels (conduits) used according to the subject invention provides a cooling effect. Also, the delivery of air can facilitate keeping the wearer's uniform dry, which promotes comfort, sweat evaporation, keeping the uniform lightweight and facilitating the body's natural cooling. The compressed air could also be cooled through active devices such as a cooler or chiller or by a device such as a Hilsch tube.

DETAILED DISCLOSURE

The subject invention provides materials and methods for decreasing or increasing internal body temperature. Advantageously, in one embodiment the systems of the subject invention can be used to lower the core temperature of the wearer of the gear. In a preferred embodiment, the materials and methods of the subject invention are used to enhance the performance and safety of athletes and others who wear close-fitting protective gear.

Among the most effective methods for reducing body temperature is convective and conductive cooling. Dehydration and temperature aberrations can be ameliorated by convective and/or conductive and/or evaporative cooling means, resulting in safety and enhanced performance. Advantageously, the materials and methods of the subject invention can, be used to achieve cooling of the human (or animal) body via intermittent and/or continuous convective and/or conductive cooling.

The materials and methods of the subject invention may also be used to achieve desired thermal heating of people, including athletes, or specific body parts, e.g., kicker's leg or pitcher's arm, in cold weather conditions. In this way, muscle injury is minimized and athletic performance is improved by keeping vulnerable limbs warm in cold environments.

The device of the subject invention may also be used with individuals who are particularly sensitive to heat, as in the case of multiple sclerosis patients and elderly people in dwellings without air conditioning.

Figure 1:
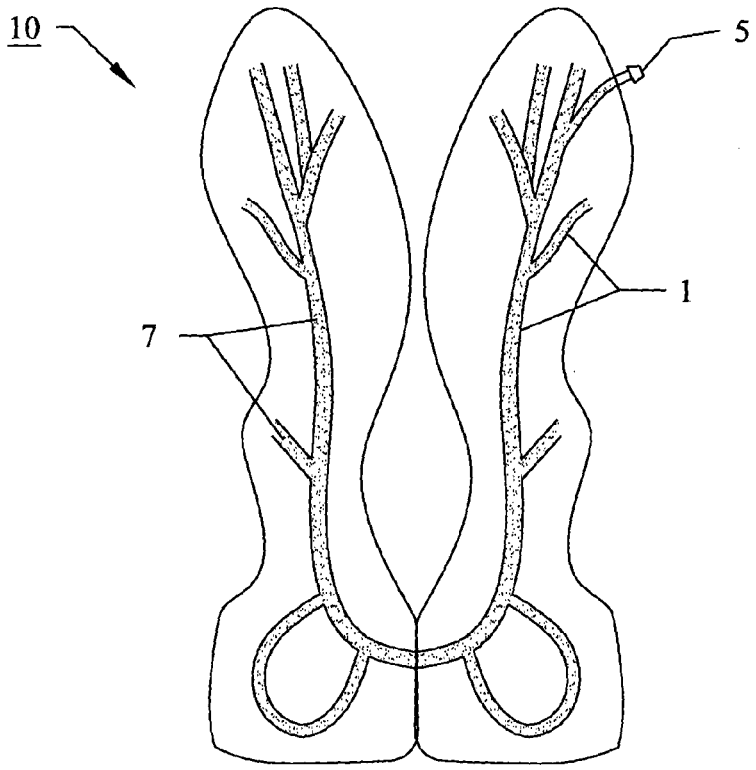
FIG. 1 illustrates a flat view of the inside of a protective gear of the subject invention.
Figure 2A:
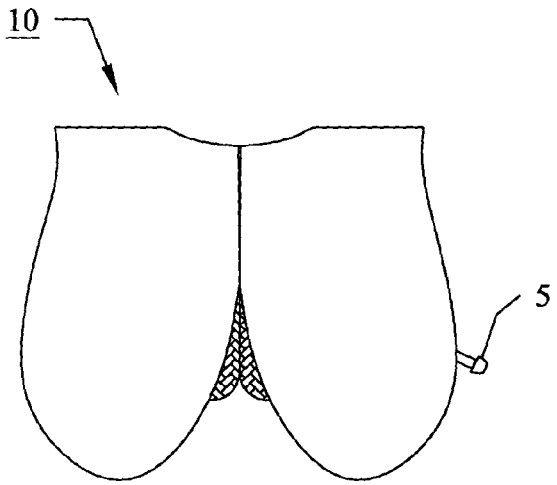
FIG. 2 illustrates the apparatus or garment of FIG. 1 as it could be worn.
Figure 2B:
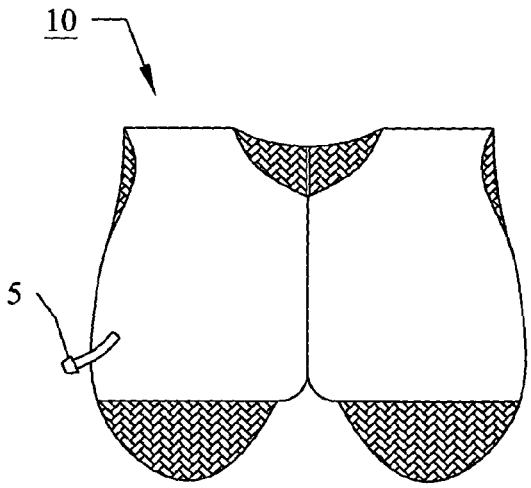

In a preferred embodiment, the subject invention involves the routing of a fluid, preferably a gas, by way of tubing vessels incorporated into a garment, to create a cooling or heating effect for the wearer of the garment (FIGS. 1 and 2). As used herein, reference to "tubing" or "tubing vessel" means any structure capable of holding and/or channeling a fluid. As would be readily appreciated by one skilled in the art, having the benefit of the instant disclosure, the "tubing vessel" may be formed by a material that is different from, but incorporated into, pads or other protective gear. Alternatively, the tubing vessel may be a channel that is cut into, or formed in, for example, pads or other protective gear. Such channels and other tubing vessels form conduits through which air, or other fluids, may pass.

In a preferred embodiment, the conduits used according to the subject invention are an integral part of a garment worn by a person or animal, rather than, for example, a "harness" type apparatus that is, for example, draped on the wearer over or under clothes. Thus, the integral conduits cannot be readily separated from, or worn separately from, the garment. The integral conduits could also be provided in the form of a kit for modifying existing gear. In a preferred embodiment, the garment is protective gear that protects the wearer against bodily insults. Bodily insults include, for example, bruises, damage to internal organs, puncture wounds, bullet holes, serious burns, broken bones, and other relatively serious injuries. Thus, in this context, protective gear would include, but not be limited to, "pads" and helmets used by football players, hockey players, and other athletes; and suits used by racecar drivers, firemen, police and military personnel. "Protective gear," as used herein, is not intended to cover standard shirts, pants, dresses and the like.

The protective gear envisioned in accordance with the subject invention would typically be close-fitting and is often heavy and/or relatively impervious to fluids such that the wearer's ability to dissipate body heat is reduced as a result of wearing the protective gear.

The subject invention facilitates heat transfer from the wearer so that, if desired, heated air can be removed from the surface of the wearer. In an alternative embodiment heat can be delivered to the surface of the wearer. The heat transfer process of the subject invention is accomplished by passing fluid through conduits that run sufficiently close to the surface of the wearer such that the fluid is in "thermal connectivity" with the wearer. As used herein, reference to "thermal connectivity" means that heat transfer can occur between the fluid and either the surface of the wearer or a substance that is immediately adjacent to the surface of the wearer. Thus, the heat transfer may occur between, for example, the fluid and the skin of the wearer; the fluid and a shirt or other garment worn by the wearer; the fluid and the hair of the wearer; or the fluid and air at or near the skin or hair of the wearer.

The conduits used in the system of the subject invention may have intermittent, or continuously placed, openings via which heat transfer occurs between the wearer and the fluid. This process of heat transfer occurs at the boundary between the conduit and the space (or material) at, or near, the skin surface of the user. Alternatively, the fluid may be separated from the heat of the wearer by a thermally conductive material, across which heat transfer can occur.

As would be readily appreciated by those skilled in the art, having the benefit of the instant disclosure, protective gear (such as football pads) is often tight-fitting and relatively (compared to a shirt, for example) impermeable to fluids and air movement, such that heat is trapped. Such protective gear is designed to protect against impacts, heat, and other bodily insults, such as those that may occur with football players, hockey players, automobile racers, police, military personnel, and firefighters. Because such protective gear is relatively fluid impervious and worn close to the body, conduits can be readily formed such that a gas, or other fluid, may pass through the conduit close to the skin surface of the wearer, thereby facilitating heat transfer between the area near the skin surface and the moving fluid.

As would be readily apparent to one skilled in the art, the tubing, channel, or other conduit may be immediately adjacent to the skin, or may be separated by, for example, an undershirt, as is customary with many such suits and uniforms. The conduits may have many small discrete perforations through which fluid may pass thereby providing the cooling or warming effect. Alternatively, an elongated perforation (opening) may be used to facilitate the heat transfer process. In the case of the elongated perforation, each tubing vessel (conduit) may have a long slit or open side, thereby forming a channel with an open side through which heat transfer can occur between the user and the fluid stream.

Typically, the conduit conveys the fluid and is open or partially open at one end. The conduit may be, for example, round, flat, or sheet-like and has an internal space capable of holding and/or conveying the fluid as the fluid passes through the protective gear, and over or through pores, slits or other openings, to facilitate heat transfer. The cross-section of the conduit may be round, square, triangle or any other appropriate shape and the shape may vary along the axis of the conduit. The conduits may form an essentially straight line or be curved. In one embodiment, the conduits are defined by the space between ridges formed in the protective gear.

The conduits of the subject invention may be, for example, roughly parallel channels running from the bottom to the top of protective gear (or vice versa). Thus, for protective gear such as shoulder pads or protective vests, pressurized air (or other fluid) may be introduced through a connection at the bottom of the device, the air then being distributed to a plurality of conduits that run, for example, vertically from the point of air entry to exit ports at, or near, the top of the device. The design allows a large airflow because the exit area for the fluid when the design incorporates a fluid outlet is relatively large. The large airflow results in more frequent air changes that may result in improved cooling.

In an alternative embodiment of the invention, the conduits or channels may be contoured so that the cross-sectional area varies along the axis of the channels or conduits. The contour may be designed to produce a location along the axis of the conduit where fluid velocity is at a maximum. This may be achieved for example by having a "throat" in the conduit where the cross-sectional area will be least and conversely, the fluid velocity will be at its maximum. Through the Venturi effect whereby a high fluid velocity produces a corresponding local area of low pressure, a region of low pressure will be created at the throat or narrowing of the conduit.

In the case of the fluid being air, a connection to ambient air such as a hole or passage could be made at, or in the vicinity of, the region of high velocity and low pressure. The low pressure would effectively entrain ambient air via the connection and thus increase or amplify the air flow in the conduit, thus reducing the consumption of compressed air. At least one or all of the conduits may have such a local narrowing of the cross-sectional area.

The conduits may be tubes made of a material that is different from the rest of the protective gear, or the tubing vessels may be channels that are cut out of, or formed in, the protective gear. The tubing vessels may have a plurality of discrete perforations or may comprise one or more elongate perforations or slits that define, for example, a channel.

The conduit directs the fluid flow in sufficient proximity to the wearer's skin surface to facilitate the transfer of heat from the wearer to the fluid. The fluid, and accompanying transferred heat, then exit the device thus cooling the wearer.

In one embodiment, the conduits of the subject invention convey pressurized air and the pressurized air exits the conduits at the top of a protective gear device. The top may be, for example, at or near the wearer's neck and head. In this embodiment, it may be desirable to reduce noise resulting from the exit of gas from the conduits. This may be achieved by, for example, slowing the rate at which the gas is passing through or exiting the channel. Such modulation of flow rate can be achieved by, for example, modifying the cross-sectional area of the conduit. The conduit may be, for example, tapered to create back pressure to reduce the flow rate. Also, as the gas exits, the diameter of the conduit can be increased to reduce the velocity of the gas and decrease the likelihood of a whistling noise. A reduction in sound can also be achieved through the use of baffles or muffling devices. Sound absorbing or sound attenuating materials and devices may be used, for example, sponges or other porous materials.

For some protective gear, existing channels formed by, for example, the configuration of pads may form the conduits necessary for sufficient conveyance of air (or other fluid) over or near a body surface. Thus, for example, a race or football helmet can be fitted with a connection facilitating introduction of air to the internal space of the helmet where it passes over the head of the wearer and exits through an opening.

In a preferred embodiment the materials and methods of the subject invention are applied to tight-fitting protective gear. Such devices traditionally do not allow for significant air flow. Accordingly, tubing vessels in the form of channels can be provided in such gear to facilitate conveyance of, preferably, compressed air that is supplied through a quick-connect fitting to a source of compressed air. The compressed air can enter a receiving conduit formed in the protective gear through which the air passes and is distributed to channels that bring the air flow into proximity with a sufficient surface area of the user, preferably the blush zones of the wearer to result in heat transfer from the user to the fluid that then exits the protective gear.

In a preferred embodiment, tubes directing pressurized gas (or other fluid) can be easily and quickly connected to the inlet port(s) located on protective gear. Preferably, the connection, whereby the conduits associated with the fluid-supplying device are connected to the inlet port(s), facilitates repeated engagement/disengagement. In one embodiment, the connection automatically disengages if the wearer forgets to disengage or if the wearer moves quickly from the proximity of the fluid source. In a preferred embodiment, fluid flow is terminated upon disengagement.

In a preferred embodiment, the transfer of heat is sufficient to improve comfort and is capable of modifying core temperature and/or the rate of change of core temperature of the user. In an alternative embodiment, the system is used to raise the temperature of, for example, a set of muscles to be used by an athlete.

The conduits of the subject invention may also be specifically designed to increase heat transfer by, for example, having channels that curve or intersect in the device. The channels may be wide and/or numerous such as in the case of the space between ridges formed in protective gear. The channels may also be made deep enough to reduce or eliminate blockage of fluid flow by, for example, bunching of an undershirt.

The heat capacity of a gas used according to the subject invention can be increased by, for example, humidifying the gas so that it contains water that increases the capacity to carry heat away from, or deliver heat to, the user. Also, in one embodiment, the fluid entering the device can be cooled. In one embodiment, a Hilsch tube can be used to separate warmer air from cooler air. The cooler air is then introduced into the device while the warmer air is discarded. Hilsch tubes, which have no moving parts, are well known, and readily used, by those skilled in the art. Other cooling devices such as coolers and chillers are well known and can be readily used.

The apparatus of the subject invention may have a fluid source that is either external or internal. As used herein, reference to an "internal" source of fluid means that the source can be worn by the athlete or other person or animal. In one embodiment, the source can be worn by an athlete during athletic performance. Thus, in the case of an internal fluid source, a self-contained unit with a reservoir for the gas source is utilized. The gas source may be, for example, dry ice that releases gaseous carbon dioxide under pressure.

In the case of an external source of the fluid, in one embodiment the device worn by the individual can be connected and disconnected from the source. In this embodiment, the fluid can be provided when, for example, an athlete, fireman, or other person or animal is in between periods of activity or resting/recovering on the sidelines or in the locker room during, for example, an intermission.

The source of fluid may also be ambient air that is forced into the system by, for example, movement. Thus, for example, a racecar driver or other individual in a moving vehicle may have ambient air directed through conduits in protective gear. The air entering the protective gear may be cooled (compared to ambient air or air leaving an air compressor) by the use of, for example, a Hilsch tube that facilitates the separation of warmer air from cooler air. The cooler air can be directed into the conduits of the gear of the subject invention and the warmer air can be directed elsewhere. Other coolers can also be used.

Figure 3:
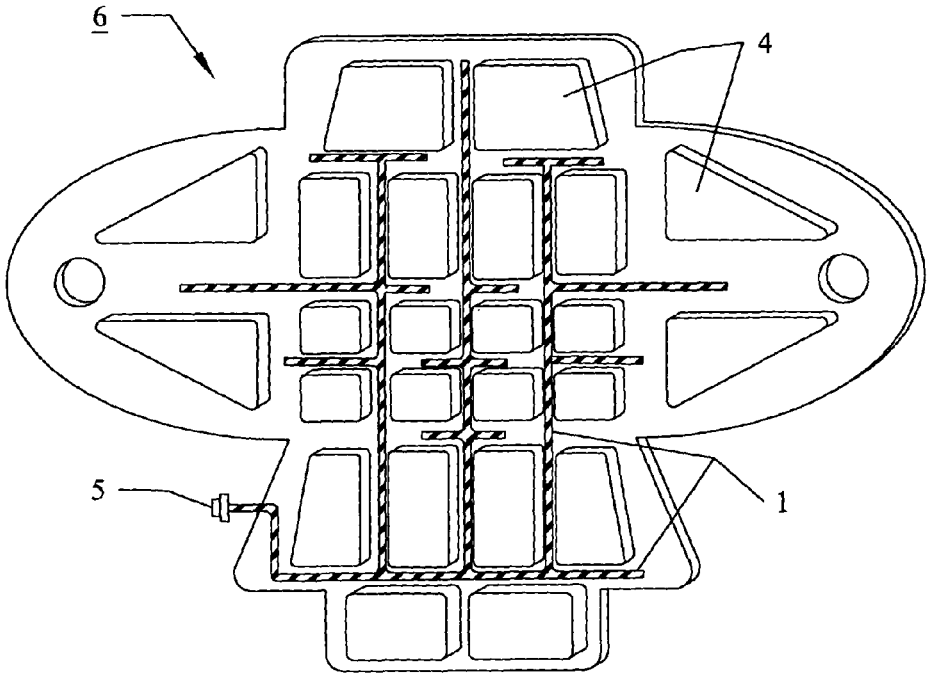
FIG. 3 illustrates a flat view of the inner lining of a standard football helmet wherein conduits have been interlaced between the padding.
Figure 4:
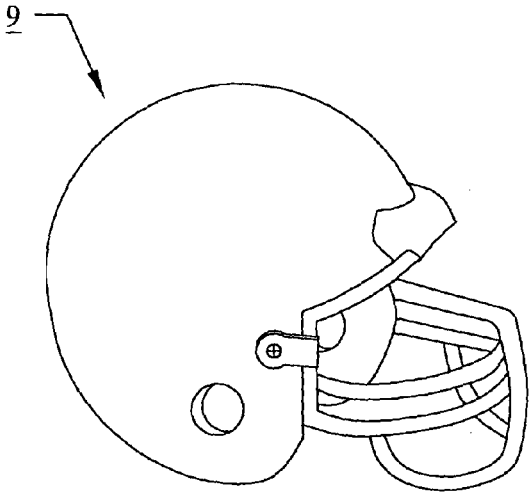
FIG. 4 illustrates a standard football helmet with the inner lining of FIG. 3 in place.

As illustrated in FIGS. 1 and 2, in one embodiment, the tubing vessels 1 are incorporated into an athlete's uniform and/or helmet 9 (FIGS. 3 and 4). If a reduction in core temperature is needed, a cooling effect can be created as pressurized air 7 in the internal space 2 of the conduit to contact a wearer's skin 3.

One embodiment of the subject invention provides protective gear 10 with an air source that is external and is equipped with a low-profile quick-connect fitting 5 for efficient connection/disconnection.

In a specific embodiment, the subject invention provides methods for modulating the body temperature of a football player. These methods preferably involve the delivery of compressed air through tubing vessels (conduits) located in a garment wherever a decrease in body temperature is desired, especially in blush zones. Advantageously, the passage of the compressed air through the tubing vessels used according to the subject invention provides a cooling effect. Also, the delivery of air facilitates keeping the wearer's uniform dry, which promotes sweat evaporation, keeping the uniform lightweight and facilitating the body's natural cooling. The materials and methods of the subject invention can be used with other athletes including, for example, hockey players.

In one embodiment, the protective gear may comprise a temperature sensor for monitoring the skin surface temperature of an individual. This temperature sensor may be monitored remotely or through a direct (engageable/disengageable) connection to the protective gear. Such a sensor can provide an indication of increasing temperature that would necessitate use of the system. Such a sensor could also be used to monitor the effectiveness of the system.

As used herein, reference to cooling or warming the wearer can refer to heat transfer that changes the core body temperature, or the temperature of a certain portion of the wearer (such as a muscle set).

In a preferred embodiment of the subject invention, the cooling system of the subject invention can be used to facilitate reducing an elevated core body temperature by at least about 0.5° F. in 30 minutes or less. In some instances, a decrease of 1° F. in 15 minutes or less can be achieved.

As noted above, the conduit may be tubing made from a material different than the protective gear or may be formed in the protective gear. If the tubing is a dissimilar material it may be, for example, polyvinyl chloride (PVC), silicone rubber, or a similar flexible, durable, lightweight, non-metallic material. The tubing or other conduit may be circular, oval or rectangular and have a larger dimension ranging from approximately 1 to 50 mm. The tubing may also be in the form of a sheet of dimensions corresponding to or smaller than the size of the garment. It is preferable for the tubing to have a shape so that it can be easily incorporated into a garment and does not restrict an athlete's movement, or otherwise cause chafing, discomfort, inconvenience or distraction. The tubing may comprise a surface, such as shown in U.S. Pat. No. 5,533,354 that serves to enhance the cooling effect of air as it exits the tube.

In a preferred embodiment of the subject invention, the shape, size and configuration of the conduits is as generally described above and is sufficient to achieve desired cooling without the need to incorporate additional structure intended to create the Coanda effect.

The fluid is preferably a gas. The fluid may be a single gas or liquid, mixture of gases, or a mixture of gases and liquids. The gas may be for example, air, nitrogen, carbon dioxide, oxygen, or a mixture of these gases. In a preferred embodiment, for reasons of costs, safety, and convenience, the fluid is compressed air sufficient to generate easily discernible gas flow. In a preferred embodiment, this flow rate can be between about 2-10 $ft^3$/min. Most preferably, the flow rate is greater than 3 $ft^3$/min. The exact flow rate will depend, to some extent, on the particular device receiving the air. The gas may be at ambient temperature or it may be warmed or cooled. The gas may be dry, dehumidified or humidified.

In a preferred embodiment, the fluid in the conduit is pressurized air. The air may be, for example, at a pressure of from about 5 psi to 60 psi. More preferably the air is at about 15 psi to about 50 psi.

Heat exchange can be facilitated by opening(s) in the conduit. The openings may be discrete holes formed in the tube at various intervals or may be an inherent characteristic of the tube as in the case of a tube made from a material which is "porous" such that the fluid passes through the tube uniformly over the porous portion of the tube or in the case of a tubing vessel with an open side.

As noted above, the tubes may be semipermeable to the fluid, have very tightly spaced perforations (a porous tube) or the perforations may be spaced apart by millimeters or even centimeters. The perforations may all face the same direction or they may surround the circumference of the tube. If the perforations all face the same direction it is preferable for the perforations to face so that air passes over the surface of the wearer's body.

The tubes 1 can be incorporated in the apparel (FIG. 5) so that they are comfortable and do not adversely affect performance. Ideally, the tubes are placed so as to maximize the cooling effect by, for example, expelling gas over large surface areas of the player's body with an emphasis on the so called "blush" zones (neck, shoulders, armpits, sternum area, etc.). The use of channels with an open side towards the wearer's body is an example of this embodiment.

When an external source of pressurized air is to be used, the compressed air can be provided by any of the well-known systems for providing compressed air. The system may be, for example, portable or installed in the sideline area of a football field so that multiple players can easily connect to the system while they are on the sideline. The connection is preferably easy to engage and disengage. In a preferred embodiment, the player can engage and disengage the connection without assistance. Accordingly, the connection 5 is preferably on or in the uniform so that it can be readily seen and/or accessed by the athlete or other wearer or other support personnel (FIG. 2). The connection 5 may be made of a material that is sturdier (and harder) than the rest of the tubing 1. In this case, the connection can be recessed, padded and/or placed in a location that is unlikely to cause injury or harm to an individual should the individual fall on, or be hit on or with, the connection.

In one embodiment, the device (gear, garment, etc) of the subject invention comprises a receiving conduit into which the fluid moves upon entering the device. The fluid then exits the receiving conduit through openings and passes into distribution conduits. Most heat transfer occurs along the distribution conduits. The distribution conduits may be channels, tubes, or the like, as described herein, wherein the fluid passes in thermal connectivity with the surface of the wearer.

Advantageously, the device of the subject invention can enhance the comfort of the wearer even when fluid is not being actively introduced into the conduit(s). This enhanced comfort is attributable, at least in part, to improved air circulation near the surface of the wearer. This improved air circulation can facilitate removal of heat and moisture, enhance evaporation, and, in general, provide for a more comfortable device (gear, garment, etc.). This effect is particularly evident when the conduits of the subject invention are in the form of channels. The use of cut-out channels reduces the surface area wherein the skin of the wearer (or the clothes of the wearer) are in direct contact with heat- and/or moisture-trapping gear.

In a further embodiment, the subject invention provides materials and methods for adapting existing protective gear with a temperature-modulating system of the subject invention. In this embodiment, conduits can be added to existing gear. The conduits can be as described herein, and can be attached through any appropriate means including, but not limited to, adhesives, velcro, thread, etc. The subject invention further contemplates rejuvenating or reconditioning systems of the subject invention through, for example, replacement of conduits. Thus, in one embodiment, the subject invention provides kits for adding the conduit system to existing gear, or rejuvenating gear that was initially produced with a system of the subject invention. The kits would typically include conduits, connectors and attachment materials. Instructions may also be provided.

All patents, patent applications, provisional applications, and publications referred to or cited herein are incorporated by reference in their entirety, including all figures and tables, to the extent they are not inconsistent with the explicit teachings of this specification.

Following are examples which illustrate procedures for practicing the invention. These examples should not be construed as limiting. All percentages are by weight and all solvent mixture proportions are by volume unless otherwise noted.

Example 1

Internal Fluid Source

In one embodiment the subject invention has an internal source of pressurized fluid. Specifically, the source of the fluid can be solid $CO_2$ (dry ice) which provides gaseous $CO_2$ as it sublimates.

Cooling may be effected by using the body's heat to provide the heat of sublimation of dry ice that may be stored within a vessel mounted on the user's garments or uniform. Appropriate temperature gradients can be established between the conductive cooling surfaces and the vessel containing dry ice so that the wearer is not exposed to the low temperature of dry ice.

The pressure generated in the vessel upon sublimation of the dry ice is around 40 psi and is sufficient to power a cooling system of the subject invention. A dry ice implementation facilitates, for example, cooling of football players while they are playing and is not limited to use while on the sidelines.

Example 2

System with External Fluid Source

In one embodiment, the subject invention provides a system. The system includes not only the garment worn by the user, but also an air supply device to which the garment (and its conduits) can be readily connected in order to introduce pressurized fluid, preferably gas, into the device. In a specific embodiment, the system is specifically adapted for use with football players. In this embodiment, the players' protective gear is outfitted with conduits as described herein.

Figure 5:
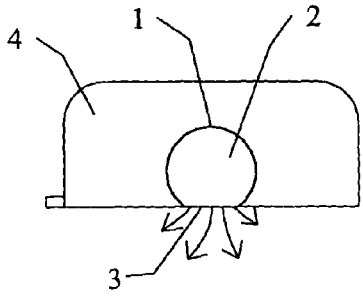
FIG. 5 illustrates a cross-section of standard protective padding wherein tubing of the subject invention is integrated within the padding such that the opening of the conduit faces the outside of the padding and towards the surface of the body.

Advantageously, the conduits may be incorporated into one of the components of the players' standard uniform. For example, football players often wear soft padding between an undershirt and hard shoulder/chest/leg pads. In a preferred embodiment, perforated tubes or other conduits are sewn or otherwise formed, in the soft padding component 4 of the uniform and or headgear 6, as shown in FIGS. 3-5. The conduits form an integral part of an existing component of the players' uniform, so they can be easily and conveniently worn.

The pressurized air sources may be available only at the bench or from hoses that provide greater mobility for the players as they receive the pressurized air.

Example 3

Use of Ambient Air

In one embodiment, the system is designed for use by a wearer in a moving vehicle. The moving vehicle may be, for example, a racecar. In this embodiment, the source of air can be ambient air outside the vehicle. The vehicle may have an air inlet system that directs the outside ambient air into the cabin of the vehicle where tubing, or other conduit, directs the air to the inlet port(s) on protective gear (or other such garment) worn by the driver (or other passenger) in the vehicle. The air may be cooled (by, for example, a Hilsch tube) or warmed prior to entering the inlet port.

In an alternative embodiment the air could be directed through the seat(s) of the vehicle thereby providing the opportunity for heat transfer.

It should be understood that the examples and embodiments described herein are for illustrative purposes only and that various modifications or changes in light thereof will be suggested to persons skilled in the art and are to be included within the spirit and purview of this application.

We claim:

1. Protective gear that protects a person or animal wearing the gear from bodily insults and which comprises at least one conduit through which fluid can be passed to cool or warm a wearer of the gear;

wherein each of said conduit(s) has an internal space through which fluid can pass in thermal connectivity with a surface of a wearer of the gear, wherein said thermal connectivity is achieved via at least one conduit having at least one opening or slit that forms a heat transfer area, whereby fluid passing through said conduit removes heat from, or delivers heat to, a wearer of the protective gear, and wherein said conduit(s) are detachably connected to said gear.

2. Protective gear that protects a person or animal wearing the gear from bodily insults and which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat transfer area, whereby fluid passing through said conduit removes heat from, or delivers heat to, a wearer of the protective gear, wherein said conduit(s) are connected to at least one inlet port through which fluid can enter said conduit(s) and at least one outlet port through which the fluid can exit said conduit(s), and wherein said protective gear further comprises a connector for connecting said inlet port(s) to a device for supplying fluid into said conduit(s).

3. Protective gear that protects a person or animal wearing the gear from bodily insults and which comprises at least one conduit through which fluid can be passed to cool or warm a wearer of the gear;

wherein each of said conduit(s) has an internal space through which fluid can pass in thermal connectivity with a surface of a wearer of the gear, wherein said thermal connectivity is achieved via at least one conduit having at least one opening or slit that forms a heat transfer area, whereby fluid passing through said conduit removes heat from, or delivers heat to, a wearer of the protective gear, wherein said conduit(s) are connected to at least one inlet port through which fluid can enter said conduit(s) and at least one outlet port through which the fluid can exit said conduit(s), and wherein said conduit(s) are tapered at, or near, the exit port of said channel(s).

4. The protective gear, according to claim 2, wherein said connector facilitates repeated engagement and disengagement of the fluid supply to said inlet port.

5. The protective gear, according to claim 2, wherein said connector can be disengaged hands-free when the wearer distances himself from the fluid supply.

6. A system for cooling or warming a person or animal wherein said system comprises:

a) protective gear that protects a person or animal wearing the gear from bodily insults and which comprises at least one conduit through which fluid can be passed to cool or warm a wearer of the gear; wherein each of said conduit (s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) a fluid-supplying device that delivers fluid to said conduit(s).

7. The system, according to claim 6, wherein at least part of the walls of said conduit are formed by the material of the protective gear.

8. The system, according to claim 6, wherein said thermal connectivity is achieved via at least one conduit having at least one elongated opening that forms a channel, whereby fluid passing through said channel removes heat from, or delivers heat to, the surface of a wearer of the protective gear.

9. The system, according to claim 6, wherein said gear protects a wearer against impacts.

10. The system, according to claim 9, wherein said gear is for use by a football player.

11. The system, according to claim 10, wherein said gear protects at least one portion of a football player wherein said portion is selected from the group consisting of the shoulders, legs, hips, pelvis, head, and upper torso.

12. The system, according to claim 6, wherein said gear is connected to a source of fluid, wherein said source of fluid is carried, or worn, by the wearer of the protective gear.

13. The system, according to claim 12, wherein said source of fluid is dry ice.

14. The system, according to claim 6, wherein said conduit (s) comprise perforations through which fluid may pass to facilitate thermal connectivity, and to remove or deliver heat.

15. The system, according to claim 6, wherein said conduits are defined by a material that is different from the material that enables the protective gear to protect the wearer against bodily insults.

16. The system, according to claim 6, wherein said conduit (s) are an integral component of said gear.

17. The system, according to claim 6, wherein said conduit (s) are detachably connected to said gear.

18. The system, according to claim 6, wherein said conduit (s) are connected to at least one inlet port through which fluid can enter said conduit(s) and at least one outlet port through which the fluid can exit said conduit(s).

19. The system, according to claim 18, wherein said protective gear further comprises a connector for connecting said inlet port(s) to a device for supplying fluid into said conduit (s).

20. The system, according to claim 18, wherein said protective gear has an inlet port for said conduit(s) at or near the bottom of said gear and outlet port(s) at or near the top of said gear.

21. The system, according to claim 20, wherein said connector facilitates repeated engagement and disengagement of the air supply to said inlet port.

22. The system, according to claim 20, wherein said connection can be disengaged hands-free when the wearer distances himself from the fluid supply.

23. The system, according to claim 6, wherein said fluid-supplying device supplies compressed air.

24. The system, according to claim 6, further comprising a means for separating fluid based upon temperature such that cooler, or warmer, fluid enters said conduit(s).

25. The system, according to claim 24, which utilizes a Hilsch tube to separate the warmer and cooler fluid.

26. The system, according to claim 6, which cools the wearer.

27. The system, according to claim 6, which warms the wearer.

28. A method, for warming or cooling a person or animal, wherein said method comprises:

a) a garment which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein said garment is connected to a source of fluid, wherein said source of fluid is carried, or worn, by the wearer of the method.

29. The method, according to claim 28, wherein said source of fluid is dry ice.

30. A method, for warming or cooling a person or animal, wherein said method comprises:

a) a garment which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein said conduit(s) are detachably connected to said garment.

31. A method, for warming or cooling a person or animal, wherein said method comprises:

a) a garment which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein said conduit(s) are connected to at least one inlet port through which fluid can enter said conduit(s) and at least one outlet port through which the fluid can exit said conduit(s), and wherein said garment further comprises a connector for connecting said inlet port(s) to a device for supplying fluid into said conduit(s).

32. A method, for warming or cooling a person or animal, wherein said method comprises:

a) a garment which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein said conduit(s) are connected to at least one inlet port through which fluid can enter said conduit(s) and at least one outlet port through which the fluid can exit said conduit(s), and wherein said conduit(s) are tapered at, or near, the exit port of said channel(s).

33. A method, for warming or cooling a person or animal, wherein said method comprises:

a) a garment which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein said conduit(s) are connected to at least one inlet port through which fluid can enter said conduit(s) and at least one outlet port through which the fluid can exit said conduit(s), wherein the garment has an inlet port for said conduit(s) at or near the bottom of said gear and outlet port(s) at or near the top of said garment, and wherein said connector facilitates repeated engagement and disengagement of the air supply to said inlet port.

34. A method, for warming or cooling a person or animal, wherein said method comprises:

a) a garment which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein said conduit(s) are connected to at least one inlet port through which fluid can enter said conduit(s) and at least one outlet port through which the fluid can exit said conduit(s), wherein the garment has an inlet port for said conduit(s) at or near the bottom of said gear and outlet port(s) at or near the top of said garment, and wherein said connection can be disengaged hand-free when the wearer distances himself from the fluid supply.

35. A method, for warming or cooling a person or animal, wherein said method comprises:

a) a garment which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein said fluid is compressed air.

36. The method, according to claim 35, wherein said fluid is humidified.

37. A method, for warming or cooling a person or animal, wherein said method comprises:

a) a garment which comprises at least one conduit through which fluid can be passed to cool or warm a wearer of the gear; wherein each of said conduit(s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein the fluid is a gas that helps to dry clothes worn by the wearer of the protective gear.

38. A kit for improving the heat transfer of protective gear, wherein said kit comprises at least one conduit through which a fluid can be passed; a connector, through fluid can be introduced into said conduit; and materials for attaching the conduit and connector to the protective gear.

39. The system, according to claim 24, wherein the fluid is compressed air, and wherein the system utilizes a cooler to cool the compressed air before it is admitted into said conduit (s).

40. The method, according to claim 35, wherein said fluid is dehumidified.

41. Protective gear that protects a person or animal wearing the gear from bodily insults and which comprises at least one conduit through which fluid can be passed to cool or warm a wearer of the gear;

wherein each of said conduit(s) has an internal space through which fluid can pass in thermal connectivity with a surface of a wearer of the gear, wherein said thermal connectivity is achieved via at least one conduit having at least one opening or slit that forms a heat transfer area, whereby fluid passing through said conduit removes heat from, or delivers heat to, a wearer of the protective gear, wherein the protective gear protects the shoulders and/or upper torso of a football player, wherein said conduits are channels that are integrally formed in the gear such that the channels have an open side that faces the wearer of the gear, wherein said channels are connected to at least one inlet port through which compressed air enters said channels and at least one outlet port through which the air exits said channels and wherein said protective gear further comprises a connector for connecting said inlet port(s) to a device for supplying compressed air into said conduits.

42. A method, for warming or cooling a person or animal, wherein said method comprises:

a) a protective gear garment which comprises at least one conduit through which fluid can be passed to cool or warm a wearer of the gear; wherein each of said conduit (s) has an internal space through which fluid can pass in thermal connectivity with a surface of a wearer of the gear, wherein said thermal connectivity is achieved via at least one conduit having at least one opening or slit that forms a heat exchange area, whereby fluid passing through said conduit removes heat from, or delivers heat to, a wearer of the protective gear; and b) supplying fluid to said conduit(s) to effect said cooling or warming by heat transfer between the person or animal and the fluid, wherein the method further comprises delivering compressed air to the protective gear, wherein the protective gear protects the shoulders and/or upper torso of a football player, wherein said conduits are channels that are integrally formed in the gear such that the channels have an open side that faces the wearer of the gear, wherein said channels are connected to at least one inlet port through which compressed air enters said channels and at least one outlet port through which the air exits said channels and wherein said protective gear further comprises a connector for connecting said inlet port(s) to a device for supplying compressed air into said conduit.

* * * * *